US010662901B2

(12) United States Patent
Nakamura

(10) Patent No.: US 10,662,901 B2
(45) Date of Patent: May 26, 2020

(54) VORTEX PUMP

(71) Applicant: AISAN KOGYO KABUSHIKI KAISHA, Obu-shi, Aichi (JP)

(72) Inventor: Eiji Nakamura, Handa (JP)

(73) Assignee: AISAN KOGYO KABUSHIKI KAISHA, Obu-shi, Aichi (JP)

( * ) Notice: Subject to any disclaimer, the term of this patent is extended or adjusted under 35 U.S.C. 154(b) by 78 days.

(21) Appl. No.: 15/778,361

(22) PCT Filed: Nov. 2, 2016

(86) PCT No.: PCT/JP2016/082584
§ 371 (c)(1),
(2) Date: May 23, 2018

(87) PCT Pub. No.: WO2017/090397
PCT Pub. Date: Jun. 1, 2017

(65) Prior Publication Data

US 2018/0347510 A1 Dec. 6, 2018

(30) Foreign Application Priority Data

Nov. 24, 2015 (JP) ..... 2015-229105

(51) Int. Cl.
*F02M 25/08* (2006.01)
*F04D 5/00* (2006.01)
(Continued)

(52) U.S. Cl.
CPC ..... *F02M 25/08* (2013.01); *F04D 5/002* (2013.01); *F04D 23/008* (2013.01);
(Continued)

(58) Field of Classification Search
CPC ..... F04D 23/008; F04D 5/002–008; F04D 29/188
(Continued)

(56) References Cited

U.S. PATENT DOCUMENTS 4,938,659 A * 7/1990 Bassler ..... F04D 29/188 415/55.1
5,009,575 A 4/1991 Hanai et al.
(Continued)

FOREIGN PATENT DOCUMENTS

DE 1921945 A1 * 1/1970 ..... F04D 5/002
DE 2531740 A1 * 2/1977 ..... F04D 23/008
(Continued)

OTHER PUBLICATIONS

International Search Report for PCT/JP2016/082584 dated Jan. 24, 2017 (4 pages.).
(Continued)

*Primary Examiner* — Michael Lebentritt
*Assistant Examiner* — Topaz L. Elliott
(74) *Attorney, Agent, or Firm* — Shumaker, Loop & Kendrick, LLP

(57) ABSTRACT

A vortex pump including: a housing including a suction channel, a discharge channel, and a housing space communicating with the suction channel and the discharge channel; and an impeller housed in the housing space and configured to rotate about a rotation axis, where the housing includes an inner channel along an outer circumference of the impeller in the housing space, and a channel cross-sectional area of the inner channel is larger than a channel cross-sectional area of the suction channel and is larger than a channel cross-sectional area of the discharge channel over an entire length of the inner channel.

5 Claims, 8 Drawing Sheets

(51) Int. Cl.
*F04D 23/00* (2006.01)
*F04D 29/18* (2006.01)
*F04D 29/40* (2006.01)

(52) U.S. Cl.
CPC ..... *F04D 29/188* (2013.01); *F04D 29/403* (2013.01); *F05B 2250/503* (2013.01)

(58) Field of Classification Search
USPC ..... 415/55.1
See application file for complete search history.

(56) References Cited

U.S. PATENT DOCUMENTS

| | | | | |
|---|---|---|---|---|
| 5,281,083 | A | 1/1994 | Ito et al. | |
| 5,718,561 | A * | 2/1998 | Fischer | F04D 23/008 415/182.1 |
| 7,156,610 | B2 * | 1/2007 | Jang | F04D 29/188 415/55.1 |
| 8,087,876 | B2 * | 1/2012 | Inuzuka | F04D 5/002 415/55.1 |
| 10,415,511 | B2 * | 9/2019 | Makino | F02M 25/08 |
| 2011/0052378 | A1 | 3/2011 | Dittmar et al. | |
| 2018/0355873 | A1 * | 12/2018 | Nakamura | F04D 23/006 |

FOREIGN PATENT DOCUMENTS

| | | | | |
|---|---|---|---|---|
| DE | 4239814 | A1 * | 6/1994 | F04D 23/008 |
| GB | 1422194 | A * | 1/1976 | F04D 23/008 |
| JP | 39-000143 | Y1 | 1/1964 | |
| JP | 47-021202 | Y1 | 7/1972 | |
| JP | 51-051503 | U1 | 4/1976 | |
| JP | H5-65896 | A | 3/1993 | |
| JP | H9-209864 | A | 8/1997 | |
| JP | H9-242689 | A | 9/1997 | |
| JP | 2002081392 | A | 3/2002 | |
| JP | 2007162588 | A * | 6/2007 | |
| WO | WO-02093014 | A1 * | 11/2002 | F04D 5/002 |

OTHER PUBLICATIONS

English Translation of Written Opinion for PCT/JP2016/082584 dated Jan. 24, 2017 (6 pages).

Office Action for Japanese Patent Application No. 2015-229105 dated Feb. 12, 2019 (7 pages including English translation).

* cited by examiner

VORTEX PUMP

TECHNICAL FIELD

The disclosure herein relates to a vortex pump. The vortex pump may also be called a Wesco pump, a cascade pump, or a regenerative pump.

BACKGROUND ART

Japanese Patent Application Publication No. H9-242689 describes a vortex pump including an impeller including a plurality of blades at its outer circumferential portion and a housing that houses the impeller. The housing includes a channel that opposes the blades of the impeller. In this vortex pump, when the impeller rotates, fluid is suctioned into the housing from a suction channel, is pressurized in the housing, and is discharged to outside from the housing through a discharge channel.

SUMMARY

Technical Problem

For example, there is a known system that flows fluid using a negative pressure generated in a fluid channel, such as a system that supplies vaporized fuel generated in a fuel tank to a supply pipe by using a negative pressure in a suction pipe of a vehicle engine. In such a system, a configuration that arranges a vortex pump on the fluid channel is being considered to enable fluid supply even in cases where a sufficient negative pressure is not generated in the fluid channel.

The disclosure herein provides a technique that efficiently uses a vortex pump in a system as described above.

Solution to Problem

The disclosure herein discloses a vortex pump. The vortex pump may comprise a housing comprising a suction channel, a discharge channel, and a housing space communicating with the suction channel and the discharge channel; and an impeller housed in the housing space and configured to rotate about a rotation axis. The housing may comprise an inner channel along an outer circumference of the impeller in the housing space. A channel cross-sectional area of the inner channel may be larger than a channel cross-sectional area of the suction channel and may be larger than a channel cross-sectional area of the discharge channel over an entire length of the inner channel.

In a system that flows fluid using a negative pressure generated in a fluid channel, the vortex pump is used auxiliary in a situation where a generated negative pressure is insufficient. In this system, the fluid can be flown without using the vortex pump in a situation where the negative pressure is sufficiently generated. Thus, in the situation where the negative pressure is sufficiently generated, the fluid passes through the housing and flows out to outside the housing even if the vortex pump is stopped from being driven and the impeller is not rotated. Due to this, a period during which the vortex pump is driven may be shortened.

According to the configuration of the vortex pump as above, the channel cross-sectional area of the inner channel in the housing is larger than each of the channel cross-sectional areas of the suction channel and the discharge channel. According to this configuration, a pressure of the fluid flowing into the housing may be suppressed from being lost. Due to this, the fluid may be flown smoothly in the housing in the situation where the vortex pump is stopped from being driven. Due to this, the vortex pump can be used efficiently.

The housing may comprise one or more opposing grooves extending along a rotation direction of the impeller, where each of the opposing grooves comprises the inner channel. A total of cross-sectional areas of the one or more opposing grooves at a cross section passing through the rotation axis may be equal to or greater than the channel cross-sectional area of the suction channel and may be equal to or greater than the channel cross-sectional area of the discharge channel over an entire length of the one or more opposing grooves. In this configuration, while the vortex pump is stopped, the fluid in the housing flows within the one or more opposing grooves and in a space between the housing and the impeller. By setting the total of the cross-sectional areas of the one or more opposing grooves greater than each of the cross-sectional areas of the suction channel and the discharge channel, an occurrence of pressure loss in the fluid may be suppressed by the one or more opposing grooves.

The impeller may comprise: a plurality of blades disposed along a rotation direction in an outer circumferential portion of at least one end surface of two end surfaces; a plurality of blade grooves, each of the plurality of blade grooves being disposed between adjacent blades; and an outer circumferential wall closing an outer circumferential side of each of the plurality of the blade grooves at an outer circumferential edge. Each of the plurality of the blade grooves may be open at the one end surface of the impeller, and may be closed at the other end surface of the impeller. In this configuration, while the vortex pump is being driven, the fluid swirling in the space defined by the blade grooves and the inner channel may be guided by the outer circumferential wall and surfaces of the blade grooves on the other end surface side of the impeller. Due to this, the fluid may be pressurized even if a revolution speed of the vortex pump is set low. As a result, the vortex pump may be used efficiently even during when the vortex pump is being driven.

Each of the suction channel and the discharge channel may extend perpendicular to the rotation axis from the outer circumference of the impeller. The housing may further comprise: a suction-side communication channel connecting the suction channel and the housing space; and a discharge-side communication channel connecting the discharge channel and the housing space. Each of a channel cross-sectional area of the suction-side communication path and a channel cross-sectional area of the discharge-side communication path may be larger than each of the channel cross-sectional area of the suction channel and the channel cross-sectional area of the discharge channel. According to this configuration, the occurrence of pressure loss in the fluid may be suppressed by the suction-side communication channel and the discharge-side communication channel in the vortex pump in which the suction channel and the discharge channel extend perpendicular to the rotation axis of the impeller.

At least one of the suction channel and the discharge channel may extend along the rotation axis direction of the impeller. The inner channel may be disposed opposing each of two surfaces of the impeller. The housing space may further comprise an outer circumferential channel located on an extension of the at least one channel of the suction channel and the discharge channel, extending along the rotation axis direction of the impeller, and the outer circumferential channel connecting the inner channels disposed on the two surfaces of the impeller at an outer circumferential side of the impeller. One of the inner channels disposed on one of the two surfaces of the impeller may be positioned upstream of the outer circumferential channel, and the other inner channel disposed on the other surface of the two surfaces of the impeller may be positioned downstream of the outer circumferential channel. A channel cross-sectional area of the outer circumferential channel in a direction perpendicular to the rotation axis may be larger than a half of the channel cross-sectional area of the suction channel, and may be larger than a half of the channel cross-sectional area of the discharge channel. In the configuration in which the inner channel disposed on the one surface of the impeller is positioned upstream of the outer circumferential channel and the other inner channel disposed on the other surface of the impeller is positioned downstream of the outer circumferential channel, about a half of the fluid flowing from the suction channel into the inner channel flows into the inner channel arranged on the one surface side of the impeller, and another half passes through the outer circumference channel and flows into the inner channel arranged on the other surface side of the impeller. By setting the channel cross-sectional area of the outer circumference channel larger than half the channel cross-sectional areas of the suction channel and the discharge channel, the occurrence of the pressure loss in the fluid may be suppressed by the outer circumference channel in the vortex pump in which at least one of the suction channel and the discharge channel extends along the rotation axis direction of the impeller.

BRIEF DISCLOSURE OF DRAWINGS

DETAILED DISCLOSURE

First Embodiment

Figure 1:
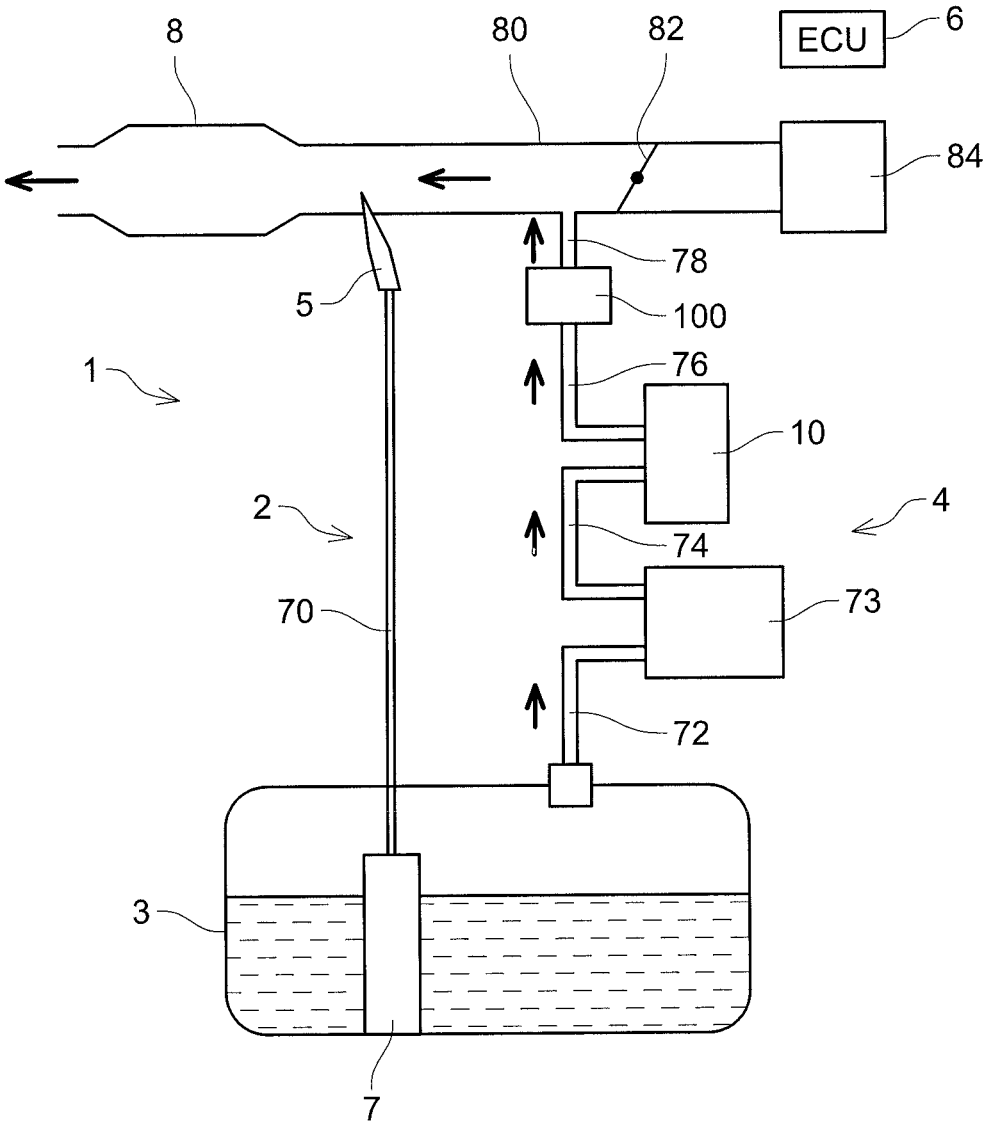
FIG. 1 is a schematic view of a fuel supply system of a vehicle of an embodiment.

A purge pump 10 of a first embodiment will be described with reference to the drawings. As shown in FIG. 1, the purge pump 10 is mounted in a vehicle, and is arranged in a fuel supply system 1 that supplies fuel stored in a fuel tank 3 to an engine 8. The fuel supply system 1 includes a main supply channel 2 and a purge supply channel 4 for supplying the fuel from the fuel tank 3 to the engine 8.

The main supply channel 2 includes a fuel pump unit 7, a supply pipe 70, and an injector 5 arranged thereon. The fuel pump unit 7 includes a fuel pump, a pressure regulator, a control circuit, and the like. In the fuel pump unit 7, the control circuit controls the fuel pump according to a signal supplied from an ECU (abbreviation of Engine Control Unit) 6 to be described later. The fuel pump pressurizes and discharges the fuel in the fuel tank 3. The fuel discharged from the fuel pump is regulated by the pressure regulator, and is supplied from the fuel pump unit 7 to the supply pipe 70.

The supply pipe 70 communicates the fuel pump unit 7 and the injector 5. The fuel supplied to the supply pipe 70 flows in the supply pipe 70 to the injector 5. The injector 5 includes a valve of which aperture is controlled by the ECU 6. When this valve is opened, the injector 5 supplies the fuel supplied from the supply pipe 70 to the engine 8.

The purge supply channel 4 is provided with a canister 73, a purge pump 10, a VSV (abbreviation of Vacuum Switching Valve) 100, and communicating pipes 72, 74, 76, 78 communicating them. The canister 73 absorbs vaporized fuel generated in the fuel tank 3. The canister 73 includes a tank port, a purge port, and an open-air port. FIG. 1 shows a flowing direction of the gas in the purge supply channel 4 and the suction pipe 80 by arrows. The tank port is connected to the communicating pipe 72 extending from an upper end of the fuel tank 3. Due to this, the canister 73 is communicated with the communicating pipe 72 extending from the upper end of the fuel tank 3. The canister 73 accommodates an activated charcoal capable of absorbing the fuel. The activated charcoal absorbs the vaporized fuel from gas that enters into the canister 73 from the fuel tank 3 through the communicating pipe 72. The gas that had flown in to the canister 73 passes through the open-air port of the canister 73 after the vaporized fuel has been absorbed, and is discharged to open air. Due to this, the vaporized fuel can be suppressed from being discharged to open air.

The purge port of the canister 73 connects to the purge pump 10 via the communicating pipe 74. Although a detailed structure will be described later, the purge pump 10 is a so-called vortex pump that pressure-feeds gas. The purge pump 10 is controlled by the ECU 6. The purge pump 10 suctions the vaporized fuel absorbed in the canister 73 and pressurizes and discharges the same. During when the purge pump 10 is driving, air is suctioned from the open-air port in the canister 73, and is flown to the purge pump 10 together with the vaporized fuel.

The vaporized fuel discharged from the purge pump 10 passes through the communicating pipe 76, the VSV 100, and the communicating pipe 78, and flows into the suction pipe 80. The VSV 100 is an electromagnetic valve controlled by the ECU 6. The ECU 60 controls the VSV 100 for adjusting a vaporized fuel amount supplied from the purge supply channel 4 to the suction pipe 80. The VSV 100 is connected to the suction pipe 80 upstream of the injector 5. The suction pipe 80 is a pipe that supplies air to the engine 8. A throttle valve 82 is arranged on the suction pipe 80 upstream of a position where the VSV 100 is connected to the suction pipe 80. The throttle valve 82 controls an aperture of the suction pipe 80 to adjust the air flowing into the engine 8. The throttle valve 82 is controlled by the ECU 6.

An air cleaner 84 is arranged on the suction pipe 80 upstream of the throttle valve 82. The air cleaner 84 includes a filter that removes foreign particles from the air flowing into the suction pipe 80. In the suction pipe 80, when the throttle valve 82 opens, the air is suctioned from the air cleaner 84 toward the engine 8. The engine 8 internally combusts the air and the fuel from the suction pipe 80 and discharges exhaust after the combustion.

In the purge supply channel 4, the vaporized fuel absorbed in the canister 73 can be supplied to the suction pipe 80 by driving the purge pump 10. In a case where the engine 8 is running, a negative pressure is generated in the suction pipe 80. Due to this, even in a state where the purge pump 10 is at a halt, the vaporized fuel absorbed in the canister 73 is suctioned into the suction pipe 80 by passing through the halted purge pump 10 due to the negative pressure in the suction pipe 80. On the other hand, in cases of terminating idling of the engine 8 upon stopping the vehicle and running by a motor while the engine 8 is halted as in a hybrid vehicle, that is, in other words in a case of controlling an operation of the engine 8 in an ecofriendly mode, a situation arises in which the negative pressure in the suction pipe 80 by the operation of the engine 8 is hardly generated. Further, in a case where a supercharger is installed, a situation arises where the suction pipe 80 is given a positive pressure by the supercharger. In such a situation, the purge pump 10 can supply the vaporized fuel absorbed in the canister 73 to the suction pipe 80 by taking over this role from the engine 8. In a variant, the purge pump 10 may be driven to suction and discharge the vaporized fuel even in the situation where the engine 8 is running and the negative pressure is being generated in the suction pipe 80.

Figure 2:
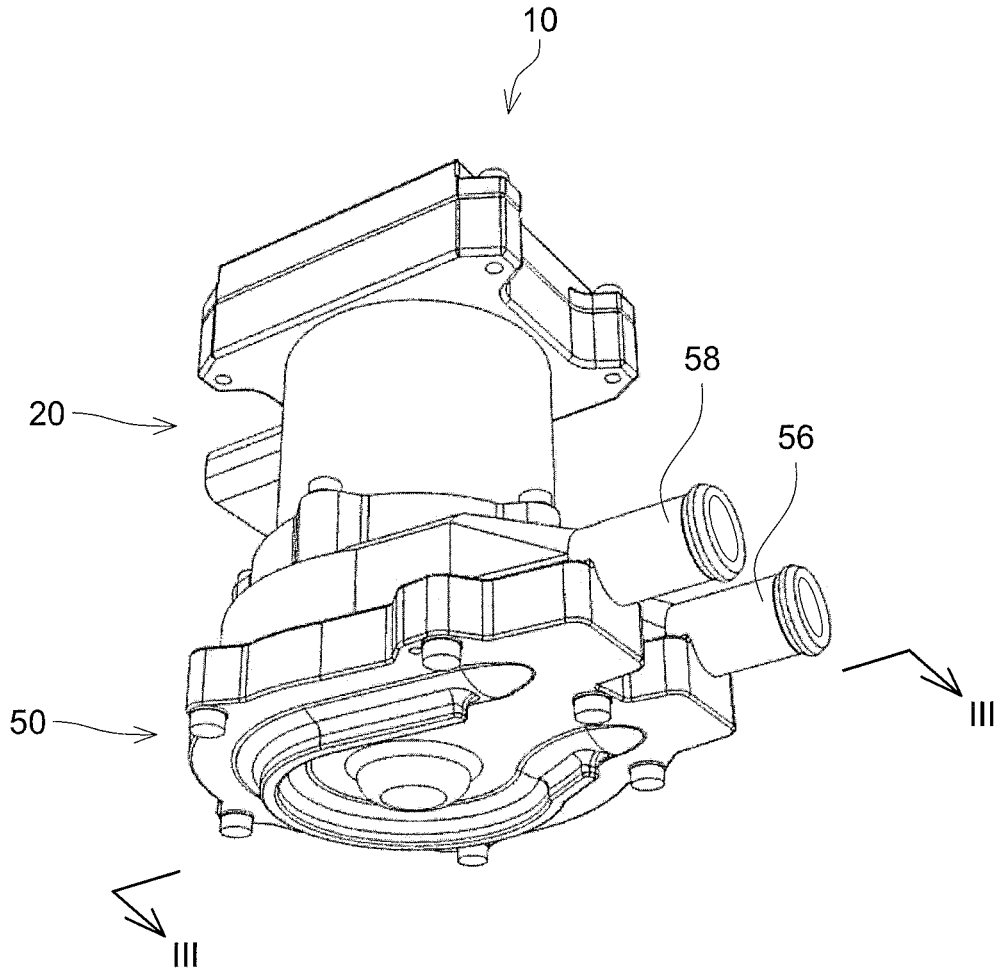
FIG. 2 is a perspective view of a purge pump of a first embodiment.
Figure 3:
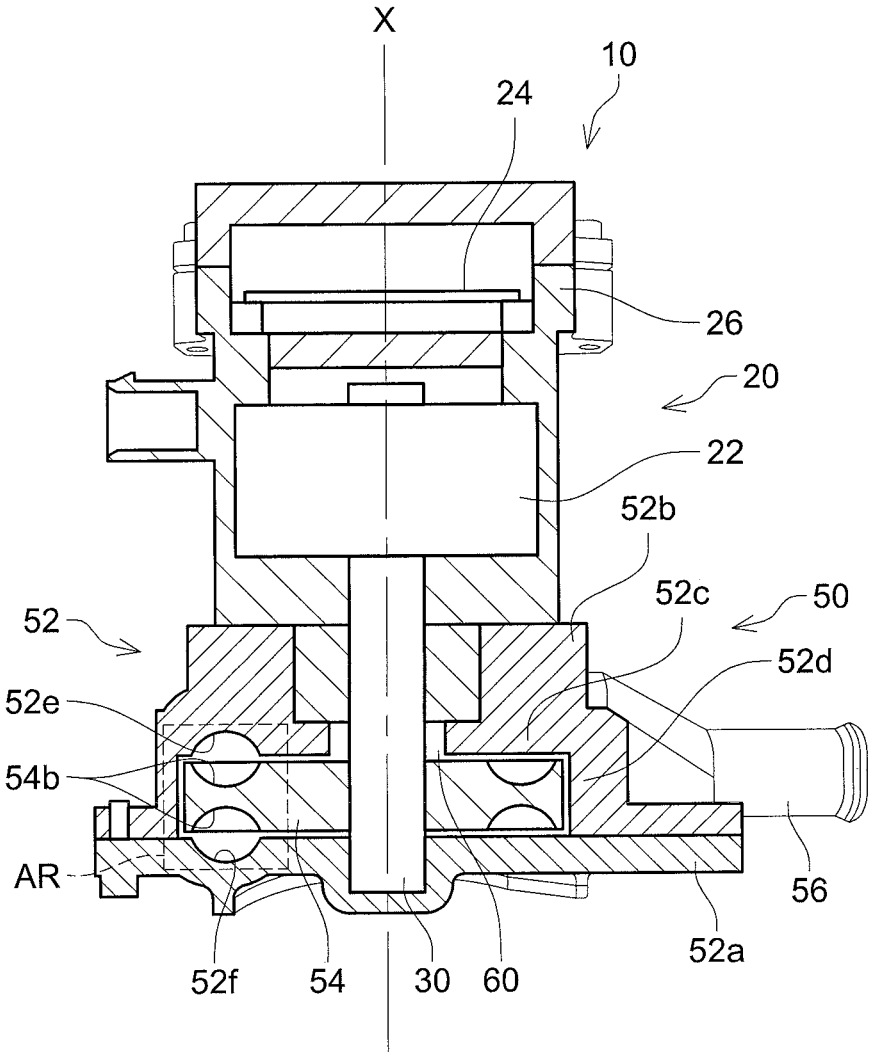
FIG. 3 is a cross-sectional view along a cross section of FIG. 2.

Next, a configuration of the purge pump 10 will be described. FIG. 2 shows a perspective view of the purge pump 10 as seen from a pump unit 50 side. FIG. 3 is a cross sectional view showing a cross section of FIG. 2. In the embodiments, "up" and "down" will be expressed with an up and down direction of FIG. 3 as a reference, however, the up and down direction of FIG. 3 may not be a direction by which the purge pump 10 is mounted on the vehicle.

The purge pump 10 includes a motor unit 20 and a pump unit 50. The motor unit 20 includes a brushless motor. The motor unit 20 is provided with an upper housing 26, a rotor (not shown), a stator 22, and a control circuit 24. The upper housing 26 accommodates the rotor, the stator 22, and the control circuit 24. The control circuit 24 converts DC power supplied from a battery of the vehicle to three-phase AC power in U phase, V phase, and W phase, and supplies the same to the stator 22. The control circuit 24 supplies the power to the stator 22 according to a signal supplied from the ECU 6. The stator 22 has a cylindrical shape, at a center of which the rotor is arranged. The rotor is arranged rotatable relative to the stator 22. The rotor includes permanent magnets along its circumferential direction, which are magnetized alternately in different directions. The rotor rotates about a center axis X (called a "rotation axis X" hereinafter) a shaft 30 by the power being supplied to the stator 22.

The pump unit 50 is arranged below the motor unit 20. The pump unit 50 is driven by the motor unit 20. The pump unit 50 includes a lower housing 52 and an impeller 54. The lower housing 52 is fixed to a lower end of the upper housing 26. The lower housing 52 includes a bottom wall 52*a* and a cover 52*b*. The cover 52*b* includes an upper wall 52*c*, a circumferential wall 52*d*, a suction port 56, and a discharge port 58 (see FIG. 2). The upper wall 52*c* is arranged at the lower end of the upper housing 26. The circumferential wall 52*d* protrudes from the upper wall 52*c* downward, and surrounds an outer circumference of a circumferential edge of the upper wall 52*c*. The bottom wall 52*a* is arranged at a lower end of the circumferential wall 52*d*. The bottom wall 52*a* is fixed to the cover 52*b* by bolts. The bottom wall 52*a* closes the lower end of the circumferential wall 52*d*. A space 60 is defined by the bottom wall 52*a* and the cover 52*b*.

Figure 5:
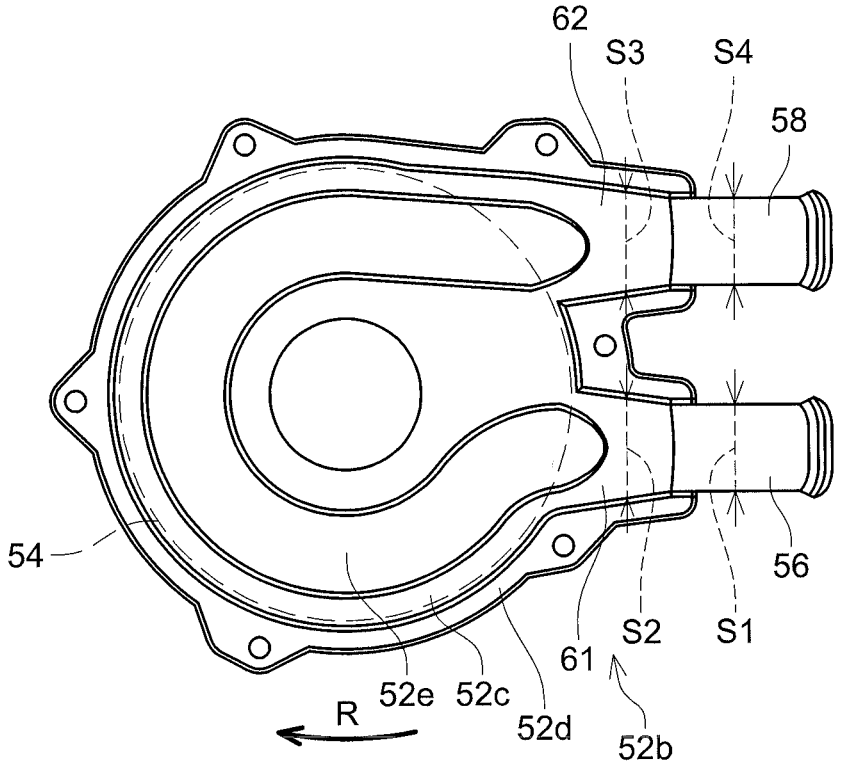
FIG. 5 is a bottom view seeing a cover of the first embodiment from below.

FIG. 5 is a diagram seeing the cover 52*b* from below. The circumferential wall 52*d* has the suction port 56 and the discharge port 58 which respectively communicates with the space 60 protruding therefrom. The suction port 56 and the discharge port 58 are arranged parallel to each other and perpendicular to the rotation axis X. The suction port 56 communicates with the canister 73 via the communicating pipe 74. The suction port 56 includes a suction channel therein, and introduces the vaporized fuel from the canister 73 into the space 60. The discharge port 58 includes a discharge channel therein, communicates with the suction port 56 in the lower housing 52, and discharges the vaporized fuel suctioned into the space 60 to outside the purge pump 10. The suction channel has a channel cross-sectional area S1, and the discharge channel has a channel cross-sectional area S4. Hereinbelow, a channel cross-sectional area will simply be termed a "cross-sectional area". The cross-sectional area S1 is a cross-sectional area at a cross section of the suction channel perpendicular to the flowing direction of the vaporized fuel, and the cross-sectional area S4 is a cross-sectional area at a cross section of the discharge channel perpendicular to the flowing direction of the vaporized fuel. That is, the cross-sectional area of the suction channel is equal to an internal area of the suction port 56, and the cross-sectional area of the discharge channel is equal to an internal area of the discharge port 58.

The upper wall 52*c* includes an opposing groove 52*e* extending from the suction port 56 to the discharge port 58 along the circumferential wall 52*d*. The bottom wall 52*a* similarly includes an opposing groove 52*f* (see FIG. 3) extending from the suction port 56 to the discharge port 58 along the circumferential wall 52*d*. The opposing groove 52*e* and the opposing groove 52*f* each have a constant depth at their respective intermediate positions excluding their both ends in a longitudinal direction, specifically, at respective positions opposing the impeller 54; and at their both ends in the longitudinal direction, they each become shallower toward the suction port 56 and the discharge port 58, respectively. When seen along a rotation direction R of the impeller 54, the discharge port 58 and the suction port 56 are separated by the circumferential wall 52*d*. Due to this, gas can be suppressed from flowing from the high-pressure discharge port 58 to the low-pressure suction port 56.

As shown in FIG. 3, the space 60 accommodates the impeller 54. The impeller 54 has a circular disk-like shape. A thickness of the impeller 54 is somewhat smaller than a gap between the upper wall 52*c* and the bottom wall 52*a* of the lower housing 52. The impeller 54 opposes each of the upper wall 52*c* and the bottom wall 52*a* with a small gap in between. Further, a small gap is provided between the impeller 54 and the circumferential wall 52*d*. The impeller 54 includes a fitting hole at its center for fitting the shaft 30. Due to this, the impeller 54 rotates about a rotation axis X accompanying rotation of the shaft 30.

Figure 4:
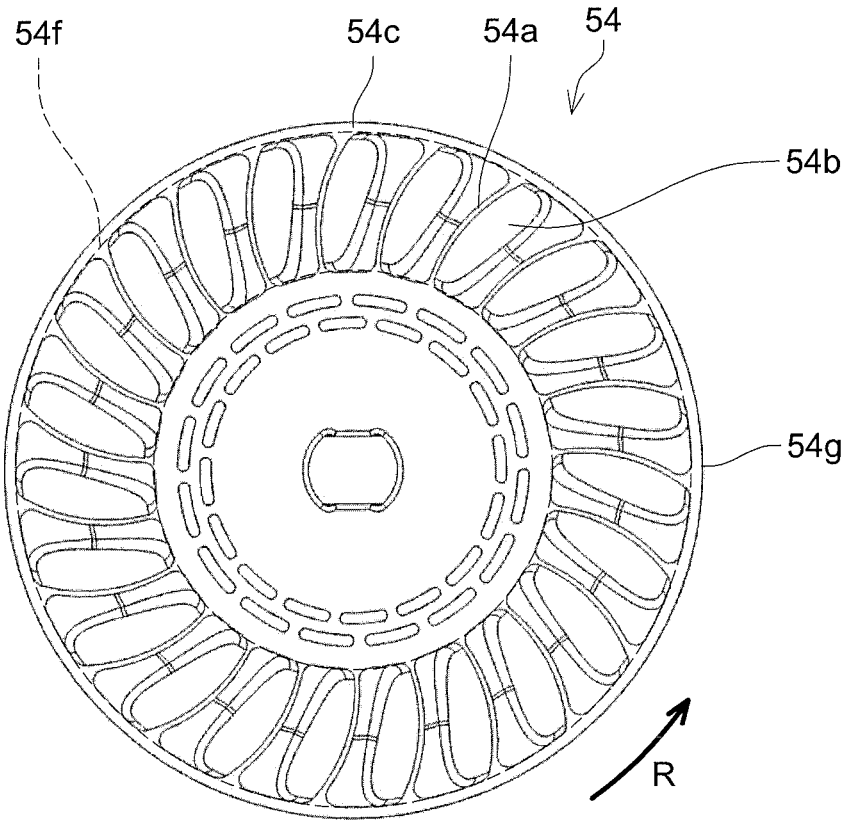
FIG. 4 is a plan view of an impeller of the first embodiment.

As shown in FIG. 4, the impeller 54 includes a blade groove region 54*f*, which includes a plurality of blades 54*a* and a plurality of blade grooves 54*b*, at an outer circumferential portion of its upper surface 54*g*. In the drawings, reference signs are given only to one blade 54*a* and one blade groove 54*b*. Similarly, the impeller 54 further includes a blade groove region 54*f*, which includes a plurality of blades 54*a* and a plurality of blade grooves 54*b*, at an outer circumferential portion of its lower surface 54*h*. The upper surface 54*g* and the lower surface 54*h* can be termed end surfaces of the impeller 54 in the rotation axis X direction. The blade groove region 54*f* arranged in the upper surface 54*g* is arranged opposing the opposing groove 52*e*. Similarly, the blade groove region 54*f* arranged in the lower surface 54*h* is arranged opposing the opposing groove 52*f*. Each of the blade groove regions 54*f* surrounds the outer circumference of the impeller 54 in the circumferential direction at an inner side of the outer circumferential wall 54*c* of the impeller 54. The plurality of blades 54*a* each has a same shape. The plurality of blades 54*a* is arranged at an equal interval in the circumferential direction of the impeller 54 in each blade groove region 54*f*. One blade groove 54*b* is arranged between two blades 54*a* that are adjacent in the circumferential direction of the impeller 54. That is, the plurality of blade grooves 54*b* is arranged at an equal interval in the circumferential direction of the impeller 54 in on the inner side of the outer circumferential wall 54*c* of the impeller 54. In other words, each of the plurality of blade grooves 54*b* has its end on an outer circumferential side closed by the outer circumferential wall 54*c*.

Figure 6:
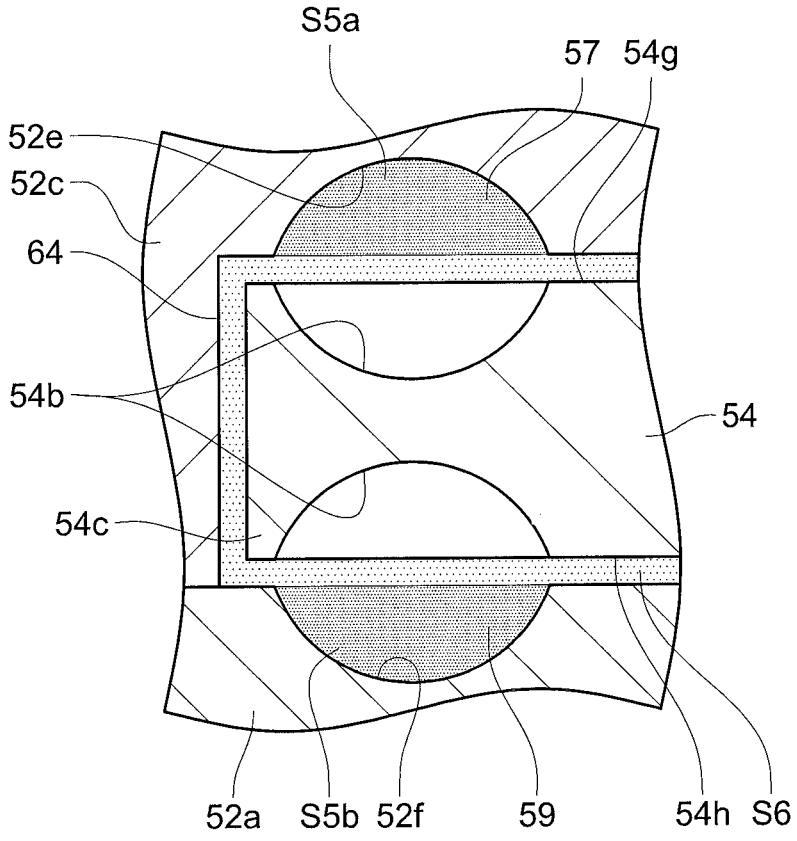
FIG. 6 is an enlarged view of a region AR of FIG. 3.

FIG. 6 is an enlarged view of a region AR of FIG. 3, and shows a cross section passing through the rotation axis X and being at a position where a depth of the blade grooves 54*b* arranged on both surfaces of the impeller 54 is the deepest. In FIG. 6, a space between the impeller 54 and the lower housing 52 is depicted large for the convenience of easy view. As shown in FIG. 6, each of the plurality of blade grooves 54*b* arranged on the lower surface 54*h* of the impeller 54 is open on a lower surface 54*h* side of the impeller 54 while closed on an upper surface 54*g* side of the impeller 54. Similarly, each of the plurality of blade grooves 54*b* arranged on the upper surface 54*g* of the impeller 54 is open on the upper surface 54*g* side of the impeller 54 while closed on the lower surface 54*h* side of the impeller 54. That is, the plurality of blade grooves 54*b* arranged on the lower surface 54*h* of the impeller 54 and the plurality of blade grooves 54*b* arranged on the upper surface 54*g* of the impeller 54 are discontinued, and are not communicated with each other. In this configuration, while the purge pump 10 is driven, the gas swirling in the spaces defined by the blade grooves 54*b* and the opposing grooves 52*e*, 52*f* can be guided by the outer circumferential wall 54*c* and bottom surfaces of the blade grooves 54*b*. Due to this, even if a revolution speed of the purge pump 10 is set low, the gas can still be pressurized. As a result, the purge pump 10 can efficiently be used while the purge pump 10 is driven.

During when the purge pump 10 is driving, the impeller 54 is rotated by the rotation of the motor unit 20. As a result, a gas containing the vaporized fuel absorbed in the canister 73 is suctioned from the suction port 56 into the lower housing 52. A vortex of the gas (swirling flow thereof) is generated in a space 57 formed by the blade grooves 54*b* and the opposing groove 52*e*. The same applies to a space 59 formed by the blade grooves 54*b* and the opposing groove 52*f*. As a result, the gas in the lower housing 52 is pressurized, and is discharged from the discharge port 58.

On the other hand, while the purge pump 10 is stopped, that is, while power supply to the purge pump 10 is stopped and the rotation of the impeller 54 according to rotation of the motor unit 20 is stopped, the vaporized fuel absorbed in the canister 73 passes through the purge pump 10 and flows into the suction pipe 80 by the negative pressure in the suction pipe 80 generated by the running engine 8.

The vaporized fuel passes through a communicating channel 61 that communicates the suction channel in the suction port 56 shown in FIG. 5 and an inner channel 64. The inner channel 64 is a channel defined by the space between the impeller 54 and the lower housing 52. Then, the vaporized fuel passes through the inner channel 64 shown in FIG. 6. Since the impeller 54 is stopped, the vaporized fuel does not flow in the blade grooves 54*b*. When the vaporized fuel flows out from the inner channel 64, it passes through a communicating channel 62 communicating the inner channel 64 and the discharge channel in the discharge port 58. Then, the vaporized fuel flows from the communicating channel 62 to the discharge channel, and is discharged to the communicating pipe 76 outside the purge pump 10.

A cross-sectional area of the opposing groove 52*e* is S5*a* (which is shown by dots in FIG. 6), and a cross-sectional area of the opposing groove 52*f* is S5*b* (which is shown by dots in FIG. 6). The cross-sectional areas S5*a*, S5*b* of the opposing grooves 52*e*, 52*f* are cross-sectional areas at a cross section perpendicular to the rotation direction R of the impeller 54, and are cross-sectional areas of the opposing grooves 52*e*, 52*f* at the cross section passing through the rotation axis X. The cross-sectional area S5*a* is equal to the cross-sectional area S5*b*. A cross-sectional area S7 of the inner channel 64 is S5 (=S5*a*+S5*b*)+S6, and a cross-sectional area S6 (which is shown by dots in FIG. 6) is a cross-sectional area at a cross section of the space between the impeller 54 and the lower housing 52 in a plane defined by the rotation axis X as one of its sides. A cross-sectional area of the communicating channel 61 is S2, and a cross-sectional area of the communicating channel 62 is S3. The cross-sectional areas S2, S3 of the communicating channels 61, 62 are cross-sectional areas at a cross section perpendicular to the flowing direction of the gas flowing in the communicating channels 61, 62. The cross-sectional areas S5*a*, S5*b* of the opposing grooves 52*e*, 52*f* and the cross-sectional areas S2, S3 of the communicating channels 61, 62 vary along the flowing direction of the gas. The cross-sectional area S1 of the suction channel, the cross-sectional area S4 of the discharge channel, and the cross-sectional area S6 are constant over an entire length of the flowing direction of the gas. In a variant, the cross-sectional areas S5*a*, S5*b*, S2, S3 may be constant and the cross-sectional areas S1, S2, S6 may vary.

The cross-sectional area S1 of the suction channel and the cross-sectional area S4 of the discharge channel are equal, a minimum value of the cross-sectional area S7 of the inner channel 64 is greater than each of the cross-sectional areas S1, S4, and each of minimum values of the cross-sectional areas S2, S3 of the communicating channels 61, 62 is greater than each of the cross-sectional areas S1, S4. Due to this, the channel area of the gas passing through the purge pump 10 from the suction channel and flowing in the discharge channel can be prevented from becoming small in the purge pump 10. As a result, an occurrence of pressure loss can be suppressed. Due to this, the gas can be passed through the lower housing 52 smoothly in the state where the purge pump 10 has stopped driving. Due to this, the purge pump 10 can be used efficiently.

Further, each of the cross-sectional areas S5*a*, S5*b* of the opposing grooves 52*e*, 52*f* is equal to or greater than each of the cross-sectional area S1 of the suction channel and the cross-sectional area S4 of the discharge channel. According to this configuration, the space between the impeller 54 and the lower housing 52 can be made small without considering a size of the cross-sectional area S6. Due to this, pump efficiency can be improved.

Second Embodiment

Figure 7:
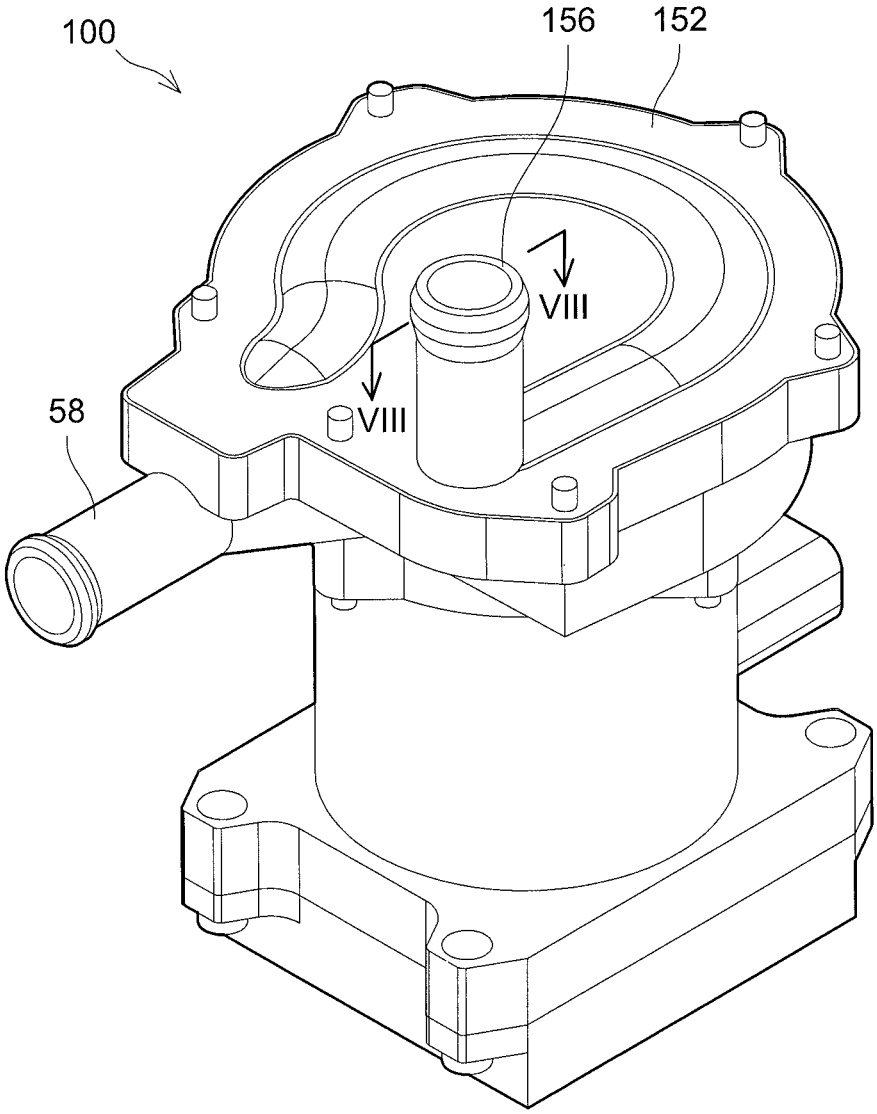
FIG. 7 is a perspective view of a purge pump of a second embodiment.
Figure 8:
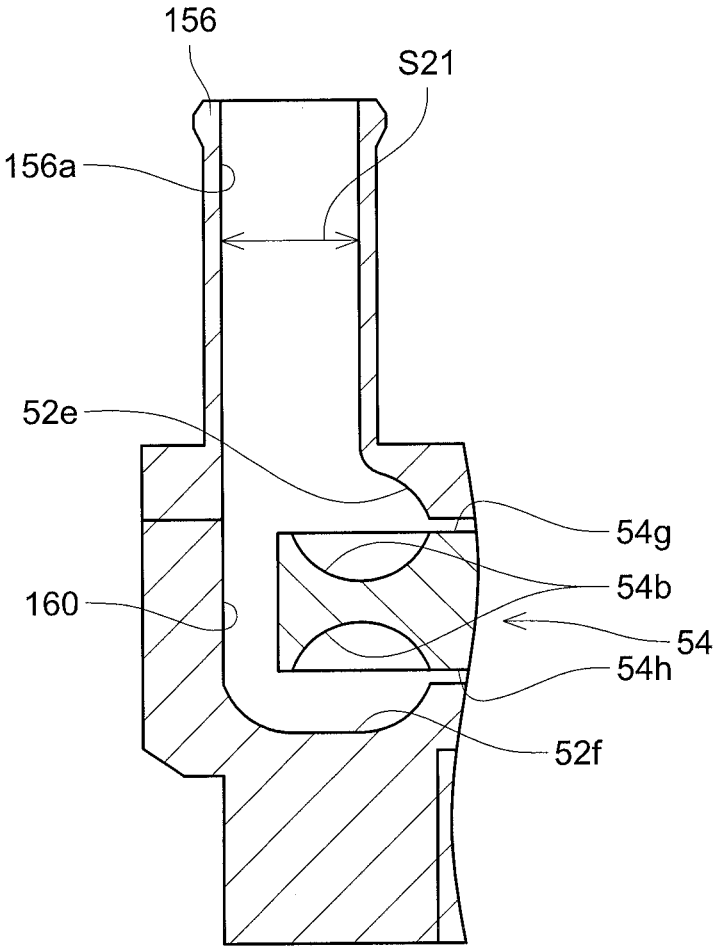
FIG. 8 is a cross-sectional view along a VIII-VIII cross section of FIG. 7.
Figure 9:
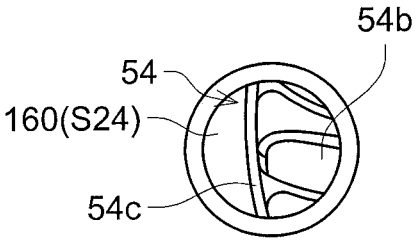
FIG. 9 is a view seeing a suction port of the purge pump of the second embodiment from above.

Features differing from the first embodiment will be described. Configurations identical to the first embodiment are given same reference signs. As shown in FIG. 7, in a purge pump 100, a suction port 156 extends parallel to the rotation axis X direction. Other configurations are identical to those of the first embodiment. FIG. 8 is a cross-sectional view of the suction port 156 and an outer circumference channel 160 located below the suction port 156 (that is, on an extension thereof). FIG. 9 is a diagram showing an inside of a housing 152 that can be seen from the suction port 156 when the suction port 156 is seen from above. As shown in FIG. 8, a suction channel 156*a* in the suction port 156 is directly connected to the opposing groove 52*e*. Further, the suction channel 156*a* is connected to the opposing groove 52*f* via the outer circumference channel 160. The opposing groove 52*e* is located upstream of the outer circumference channel 160, and the opposing groove 52*f* is located downstream of the outer circumference channel 160.

As shown in FIG. 9, the outer circumference channel 160 is a channel located on an extension of the suction channel 156*a*, and is a space included in the space between the circumferential edge of the impeller 54 and the housing 152, which is in a range that overlaps with the suction channel 156*a* if the suction channel 156*a* is extended. A cross-sectional area S24 of the outer circumference channel 160 is greater than a half of a cross-sectional area S21 (=the cross-sectional area S1) of the suction channel 156*a*, and is greater than a half of the cross-sectional area S2 of the discharge channel in the discharge port 58.

When the gas passes through the suction channel 156*a* and flows into the inner channel 64, the gas at about a half of an amount that had passed through the suction channel 156*a* flows to the opposing groove 52*e* side while the gas at about a remaining half of the amount passes through the outer circumference channel 160 and flows to the opposing groove 52*f* side. By setting the cross-sectional area S24 of the outer circumference channel 160 to be greater than the half of the cross-sectional area S21, the pressure loss of the gas can thereby be suppressed.

In a variant, the discharge port 58 may extend parallel to the rotation axis X direction. In this case, an outer circumference channel, which is a channel located on an extension of the discharge channel and is a space included in the space between the circumferential edge of the impeller 54 and the housing 152, which is in a range that overlaps with the discharge channel if the discharge channel is extended, may be greater than a half of the cross-sectional area S21 (=the cross-sectional area S1) and greater than a half of the cross-sectional area S2.

Further, the suction channel 156*a* may not be parallel to the rotation axis X, and may be inclined at equal to or less than 90 degrees relative to the rotation axis X. The same is applied to the discharge channel.

The embodiments of the present invention have been described above in detail, however, these are mere examples and thus do not limit the scope of the claims. The techniques recited in the claims encompass configurations that modify and alter the above-exemplified specific examples.

For example, the shape of the outer circumferential wall 54*c* of the impeller 54 is not limited to the shape in the embodiments. For example, the outer circumferential wall 54*c* may be arranged at a center portion in a vertical direction of the impeller 54 while not being arranged at upper and lower ends of the impeller 54. In this case, an upper end of the outer circumferential wall 54*c* may be located at a same position as the vortex center in the vertical direction or thereabove. A lower end of the outer circumferential wall 54*c* may similarly be located at a same position as the vortex center in the vertical direction or therebelow. Alternatively, the impeller 54 may not include the outer circumferential wall 54*c*.

Further, in the above embodiments, the blades 54*a* and the blade grooves 54*b* of the impeller 54 have same shapes on the upper and lower surfaces 54*g*, 54*h*. However, the shapes of the blades 54*a* and the blade grooves 54*b* may be different in the upper surface 54*g* from those of the lower surface 54*h*. Alternatively, the blades 54*a* and the blade grooves 54*b* may be arranged on only one of the upper and lower surfaces 54*g*, 54*h*.

The "vortex pump" in the disclosure herein is not limited to the purge pump 10, and may be used in other systems. For example, it may be used as a pump that supplies an exhaust to the suction pipe 80 in an exhaust recirculation (that is, EGR (abbreviation of Exhaust Gas Recirculation)) for circulating the exhaust of the engine 8, mixing it with suctioned air, and supplying the same to a fuel chamber of the engine 8. Further, it may be used as an industrial pump other than for the vehicle. Moreover, the "vortex pump" in the disclosure herein may be a vortex pump for liquid, such as a fuel pump, for example.

The channel cross-sectional areas of the suction channel and the discharge channel may be different from each other. Similarly, the channel cross-sectional areas of the opposing grooves 52*e*, 52*f* may be different from each other.

The lower housing 52 as above is provided with the opposing grooves 52*e*, 52*f*. However, the opposing grooves 52*e*, 52*f* may not be distinguished from each other. For example, the lower housing 52 may include regions respectively opposing the blade groove regions 54*f* of the upper and lower surfaces 54*g*, 54*h* of the impeller 54 and a region communicating those regions at the outer circumferential edge of the impeller 54. In this case, an inner channel configured by each of the regions being separated away from the impeller 54 by a same distance (that is, the respective regions are communicated without any step).

Further, the technical features described herein and the drawings may technically be useful alone or in various combinations, and are not limited to the combinations as originally claimed. Further, the art described in the disclosure and the drawings may concurrently achieve a plurality of aims, and technical significance thereof resides in achieving any one of such aims.

The invention claimed is:

1. A vortex pump comprising:

a housing comprising a suction channel, a discharge channel, and a housing space communicating with the suction channel and the discharge channel; and an impeller housed in the housing space and configured to rotate about a rotation axis, wherein the housing comprises an inner channel along an outer circumference of the impeller in the housing space, and a channel cross-sectional area of the inner channel is larger than a channel cross-sectional area of the suction channel and is larger than a channel cross-sectional area of the discharge channel over an entire length of the inner channel, wherein the housing comprises one or more opposing grooves extending along a rotation direction of the impeller, each of the one or more opposing grooves comprising the inner channel, each of the one or more opposing grooves has a constant depth at an intermediate position excluding both ends of the opposing groove in the rotation direction of the impeller, and each of the one or more opposing grooves becomes shallower toward the suction channel and the discharge channel at the both ends of the opposing groove respectively.

2. The vortex pump as in claim 1, wherein the housing houses the impeller with a gap, the channel cross-sectional area of the inner channel includes a cross-sectional area of the gap between the housing and the impeller, and a total of cross-sectional areas of the one or more opposing grooves at a cross section passing through the rotation axis is equal to or greater than the channel cross-sectional area of the suction channel and is equal to or greater than the channel cross-sectional area of the discharge channel over an entire length of the one or more opposing grooves.

3. The vortex pump as in claim 1, wherein the impeller comprises:

a plurality of blades disposed along a rotation direction of the impeller in an outer circumferential portion of at least one end surface of two end surfaces in the rotation axis, and a plurality of blade grooves, each of the plurality of blade grooves being disposed between adjacent blades; and an outer circumferential wall closing an outer circumferential side of each of the plurality of the blade grooves at an outer circumferential edge of the impeller, and each of the plurality of the blade grooves is open at the one end surface of the impeller, and is closed at the other end surface of the impeller.

4. The vortex pump as in claim 1, wherein each of the suction channel and the discharge channel extends perpendicular to the rotation axis from the outer circumference of the impeller, the housing further comprises:

a suction-side communication channel connecting the suction channel and the housing space; and a discharge-side communication channel connecting the discharge channel and the housing space, and each of a channel cross-sectional area of the suction-side communication channel and a channel cross-sectional area of the discharge-side communication channel is larger than each of the channel cross-sectional area of the suction channel and the channel cross-sectional area of the discharge channel.

5. The vortex pump as in claim 1, wherein at least one of the suction channel and the discharge channel extends along the rotation axis direction of the impeller, the inner channel is disposed opposing each of two surfaces of the impeller, the housing space further comprises an outer circumferential channel located on an extension of the at least one channel of the suction channel and the discharge channel, extending along the rotation axis direction of the impeller, and the outer circumferential channel connecting the inner channels disposed opposing each of the two surfaces of the impeller at an outer circumferential side of the impeller, one of the inner channels disposed on one of the two surfaces of the impeller is positioned upstream of the outer circumferential channel, and the other inner channel disposed on the other of the two surfaces of the impeller is positioned downstream of the outer circumferential channel, and a channel cross-sectional area of the outer circumferential channel in a direction perpendicular to the rotation axis is larger than a half of the channel cross-sectional area of the suction channel, and is larger than a half of the channel cross-sectional area of the discharge channel.

* * * * *